United States Patent [19]

Masuda et al.

[11] Patent Number: 4,908,513

[45] Date of Patent: Mar. 13, 1990

[54] CHARGING APPARATUS

[75] Inventors: Keiji Masuda; Kazuhiro Nakazawa; Hiroaki Ura, all of Hachioji, Japan

[73] Assignee: Konica Corporation, Tokyo, Japan

[21] Appl. No.: 247,693

[22] Filed: Sep. 22, 1988

[30] Foreign Application Priority Data

Sep. 25, 1987 [JP] Japan ..... 62-241924
Sep. 25, 1987 [JP] Japan ..... 62-241926

[51] Int. Cl.[4] ..... G03G 15/02

[52] U.S. Cl. ..... 250/324; 250/325; 250/326

[58] Field of Search ..... 250/324, 325, 326; 361/230

[56] References Cited

U.S. PATENT DOCUMENTS 3,800,153 3/1974 Matsumoto et al. ..... 250/325
3,811,048 5/1974 Matsumoto et al. ..... 250/324
3,842,273 10/1974 Van Buskirk ..... 250/324
3,937,960 2/1976 Matsumoto et al. ..... 361/230
4,734,580 3/1988 Rodrigo et al. ..... 250/324
4,788,573 11/1988 Nakaoka et al. ..... 250/324
4,841,146 6/1989 Gundlach et al. ..... 250/324
4,843,422 6/1989 Mampaey et al. ..... 250/324

*Primary Examiner*—Janice A. Howell
*Assistant Examiner*—Kiet Nguyen
*Attorney, Agent, or Firm*—Jordan B. Bierman

[57] ABSTRACT

A charging apparatus wherein a back plate forming a back portion of a shielding member surrounding a discharging wire has an elongate opening for guiding a cleaning member for cleaning and defining a cleaning region of the wire and a cam groove communicating the elongate opening for separating the cleaning member from the wire. The distance between the discharging wire and a side plate of the shielding member is larger than the distance between the discharging wire and the back plate.

6 Claims, 6 Drawing Sheets

CHARGING APPARATUS

BACKGROUND OF THE INVENTION

1. Field of the Invention

The invention relates to an improvement of a charging apparatus for charging a photosensitive member in the electrostatic recording equipment.

2. Description of the Prior Art

An image generating section of the electrostatic recording equipment such as electrophotographic reproducing machines uses a charging apparatus that incorporates slender discharging wires as electrodes.

The charging apparatus has an elongate frame of shielding member in which discharging tungsten wires, each several tens of microns in diameter, are stretched and applied with high voltages to produce corona discharges to apply charges to the photosensitive member. As is known, the wires easily accumulate toner particles, paper particles or other solid material of oxide layers and these accumulated foreign matters will disturb uniform distribution of intensity of charges, resulting in uneven density of copied images.

For this reason, the charging apparatus requires a cleaning device to clean the discharging wires. Generally, the wires are cleaned over the entire length by sliding the cleaning member supported on the shield member to rub the wires.

In the charging apparatus with two discharging wires, it is advantageous that the cleaning member be supported on a back plate which forms a back portion of the shielding member. Thus, the back plate has an elongate opening in which the cleaning member is supported and inserted.

However, in the shielding member of the above structure in which the opening is formed in the back plate to encourage discharging from the wires to the back plate, there is a problem that an increased discharging to the back plate will result in lightnings to the edges of the opening, disturbing effective discharging to the photosensitive member. On the other hand, when, to avoid this undesired phenomenon, more charges are made to reach the side plates with no opening—which form the side portions of the shielding member—than the back plate, the ion flow toward the photosensitive member and the ion flow toward the side plates combine to increase the corona winds which in turn disperse toner particles removed from the photosensitive member, disturbing the copied images or contaminating the interior of the equipment.

In the charging apparatus in Japanese Patent Laid-Open No. 62-86,375 a shielding member and a cleaning device for cleaning a discharging wire are provided. In said apparatus on the back plate of the shielding member, no opening for supporting and guiding the cleaning member is provided, but guide rails are provided to guide the cleaning member. Further, means for rotating the cleaning member in the guide rails is provided to separate the cleaning member from the discharging wire. Accordingly, the charging apparatus becomes complicated in construction and the cleaning member is unstable in the cleaning operation because it may be rotated in the guide rails inadvertently.

In the charging apparatus in Japanese Utility Model Laid-Open No. 50-73,440, an elongate opening is provided on the back plate. However, a special means for separating a cleaning member from a discharging wire is provided so that the charging apparatus becomes complicated in construction.

SUMMARY OF THE INVENTION

An object of the invention is to provide a charging apparatus wherein a cleaning member can be separated from a discharging wire easily with a simple construction.

This object can be achieved by a charging apparatus comprising a discharging wire, a shielding member U-shaped in cross section for surrounding said wire, and a wire cleaning member for cleaning said wire, wherein a back plate forming a back portion of said shielding member has an elongate opening for guiding said cleaning member and defining a cleaning region of said wire and a cam groove communicating said elongate opening for separating the cleaning member from the wire.

Another object of the invention is to provide a charging apparatus which prevents occurrence of lightning and thereby ensures effective discharging onto the photosensitive member while at the same time minimizing the corona winds that will disperse toner particles.

This object can be achieved by a charging apparatus which has a shielding member, U-shaped in cross section, enclosing two discharging wires; which has an opening at a back plate that forms the back portion of the shielding member; and which is so constructed that more charges will reach the back plate than side plates that are located at the both sides of the back plate.

Further object of the invention is to provide a charging apparatus which prevents occurrence of lightning to an edge of an opening provided on a back plate for guiding and holding a cleaning member.

This object can be achieved by a charging apparatus comprising a discharging wire, a shielding member U-shaped in cross section for surrounding said wire, and a wire cleaning member movable along a back plate forming a back portion of said shielding member for cleaning said wire, wherein the discharging is effected from the wire to a photosensitive member and to the back plate, and said wire cleaning member can be separated from said wire and positioned between the edge of the opening and the wire to prevent the lightning to the edge from being occurred.

Other objects and features of this invention will become apparent from the following description and the attached drawings.

PREFERRED EMBODIMENT OF THE INVENTION

Figure 1A:
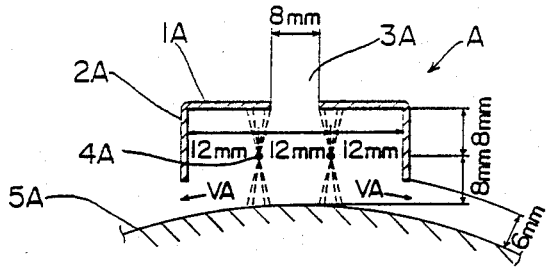
FIG. 1A is a cross section of shielding member of a charging apparatus of the present invention.
Figure 1B:
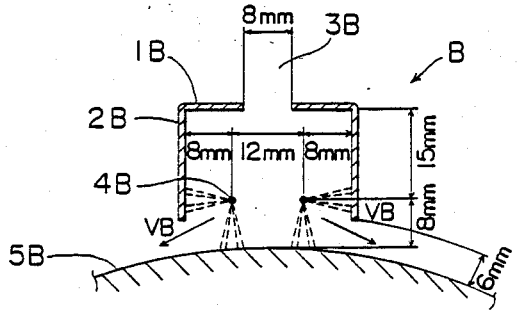
FIG. 1B PRIOR ART
FIG. 1B is a cross section of a conventional shielding member.

FIG. 1A shows a cross section of a shielding member A of a charging apparatus according to the invention and example dimensions of the shielding member. FIG. 1B shows a cross section and example dimensions of a conventional shielding member B for comparison with the shielding member A of this invention.

The shielding members A and B both are formed of a metal member U-shaped in cross section as shown and are 450 mm long, which corresponds to the width of a photosensitive drum 5A or 5B. The shielding members A and B each consists of a back plate 1A or 1B and a pair of side plates 2A or 2B formed integral with the back plate. Preferably, at least the side plates *2a, 2b,* of the shielding member are insulated.

At the center of the back plate 1A or 1B, an elongate opening 3A or 3B, 8 mm wide, is formed to support and guide a cleaning member (not shown) mounted to the back plate.

A charging electrode block (not shown) is provided to each side of the shielding members A or B. Between the opposing blocks a pair of discharging wires 4A or 4B are parallelly installed 12 mm apart.

The distance of the discharging wire 4A or 4B to the back plate 1A or 1B of each shielding member and to the side plate 2A or 2B are 8 mm and 12 mm respectively for the shielding member A and 15 mm and 8 mm respectively for the shielding member B. That is, the shielding member B of the conventional charging apparatus is so structured that the discharging wires 4B are spaced more from the back plate 1B than from the side plates 2B. On the other hand, in the shielding member A of the charging apparatus of this invention, the discharging wires 4A are spaced more from the side plates 2A than from the back plate 1A.

Therefore, in the conventional charger, electric discharges are generated from the discharging wires 4B to the photosensitive drum 5B and to the side plates 2B perpendicular to the drum 5B, so that there inevitably occur large corona winds VB caused by the vector sum of perpendicular ion flows as shown. In the charger of this invention, however, since the distance between the back plate and the discharging wires is smaller than the distance between the side plates and the discharging wires, electric discharges are generated from the discharging wires 4A to the photosensitive drum 5A and to the back plate 1A located on the side opposite to the drum 5A. The corona winds VA due to the vector sum of symmetrical ion flows, therefore, are very small compared to the corona winds VB.

In a type where more electric discharges are made to flow to the back plate than to the side plates, lightning to the edges of the opening can be prevented by properly shifting the edges from the position immediately above the discharging wires 4A by reducing the width of the opening than the distance between the discharging wires 4A or shifting horizontally the discharging wires toward the side plates with respect to the edges of the opening.

Figure 2A:
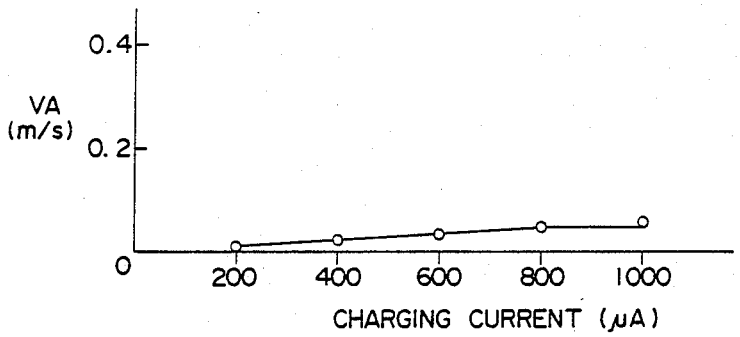
FIGS. 2A and 2B are corona wind velocity graphs.
Figure 2B:
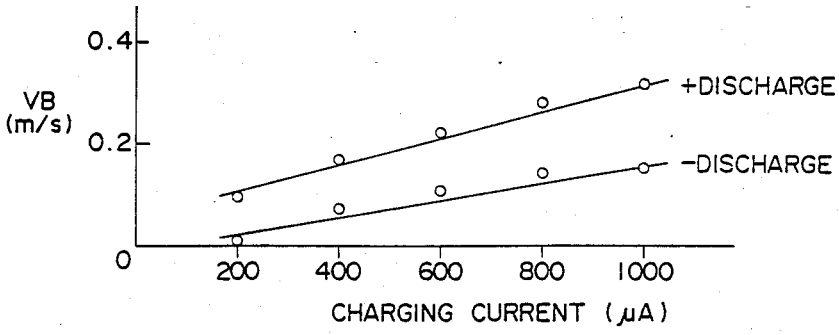
FIG. 2 B PRIOR ART

FIGS. 2A and 2B show graphs quantitatively illustrating the corona winds VA and VB in relation to charging currents in the discharging wires. For example, when the charging current is 800 μA, the corona wind VB is 0.1 meter per second while the corona wind VA is only 0.03 meter per second. The measurement of the corona winds VA and VB was taken on the drum surface 90 mm inward from the end of the drum when at rest for the drum current value of 300 μA.

Figure 3A:
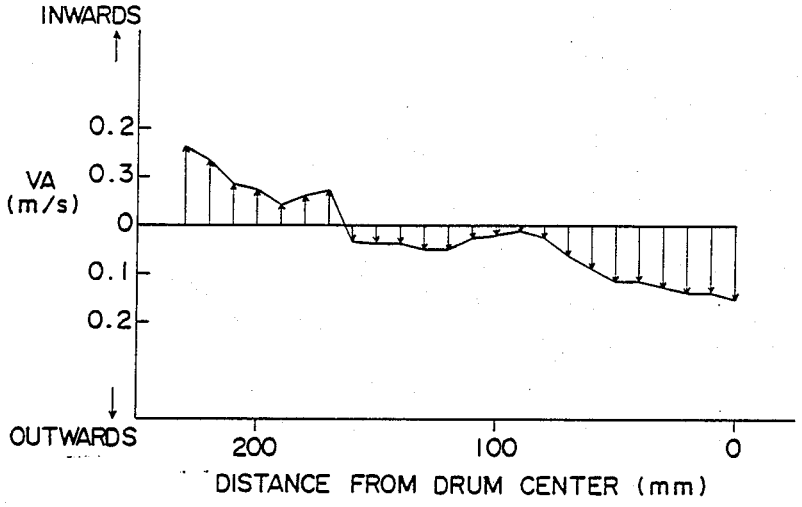
FIG. 3A is a corona wind distribution diagram for a discharging apparatus of the invention.
Figure 3B:
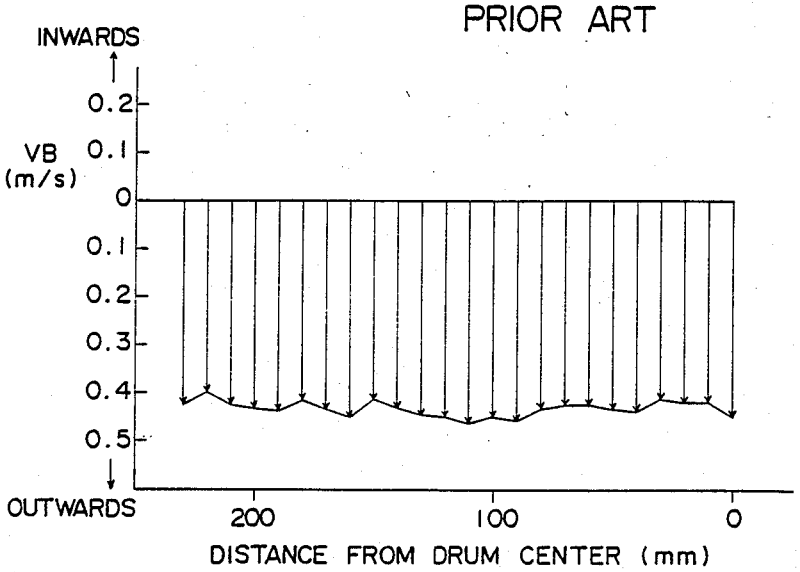
FIG. 3 B PRIOR ART
FIG. 3B is a corona wind distribution diagram for a conventional discharging apparatus.

FIGS. 3A and 3B show the distributions of the corona winds VA and VB that occurred on the photosensitive drums when the charging current was set at 1000 μA.

As seen from the figures, in the conventional charging apparatus the corona wind VB blows in large amounts outwardly from the shielding member B at any points on the drum, whereas in the charging apparatus of this invention, the corona wind VA at the ends of the drum flows into the shielding member A, in a direction opposite to the one in the conventional charger, making the resultant amount of air flow very small. Each of FIGS. 3A and 3B shows the wind distribution or the surface of only one half of the drum in the axial direction thereof.

As another embodiment of the invention, it is possible to form with an insulating material the side plates of the shielding member which has an opening or to provide an insulating member to the side of each side plate facing the discharging wires to make the discharging to the back plate more active than to the side plates. In this example, the relation between the discharging wire distance to the side plate and the distance to the back plate does not matter in ensuring the discharging to the back plate.

Figure 4:
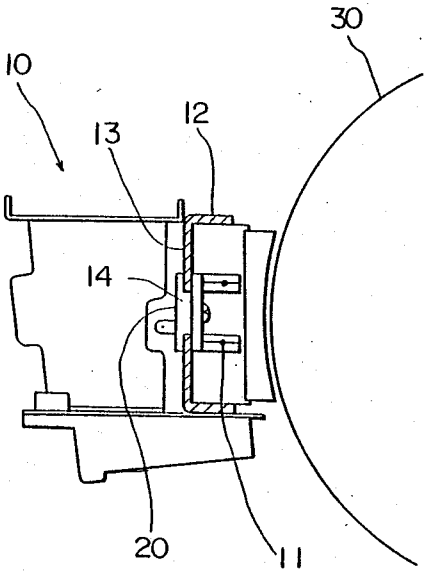
FIG. 4 is a cross section of the charging apparatus of the invention.

A charging apparatus 10 in the other embodiment of the invention which is disposed to face the outer circumferential surface of a photosensitive drum 30 comprises, as shown in FIG. 4, a pair of discharging wires 11, a shielding member 12 U-shaped in cross section for surrounding said wires 11, a back plate 13 forming a back portion of said shielding member 12, an elongate opening 14 formed on the center or the other position of said back plate 13, and a cleaning member 20 supported by said opening 14 and guided slidably along the opening 14. The pair of discharging wires 11 may be disposed in parallel with each other with a distance therebetween smaller than the width of the opening 14. Two or more openings may be provided on the back plate.

Figure 5:
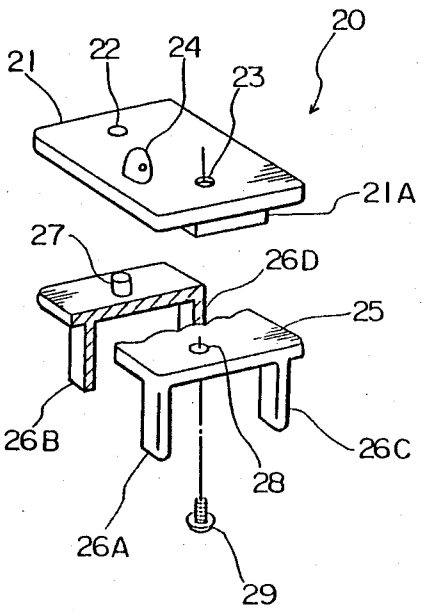
FIG. 5 is an exploded view of a cleaning member of the charging apparatus.

Said cleaning member 20 is composed, as shown in FIG. 5, of an outer plate 21 and an inner plate 25.

The outer plate 21 is a hard resin member of an electrically insulating material and having a rectangular step portion 21A integrally formed thereon and slidably fitted on said opening 14, whereas the inner plate 25 is a resilient and somewhat soft resin member of an electrically insulating material having four projected wire cleaner portions 26A, 26B, 26C and 26D integrally formed thereon.

The step portion 21A of said outer plate 21 is fitted slidably in the opening 14 of the back plate 13 from the outside thereof, and connected to said inner plate 25 disposed inside of the back plate 13 by inserting a pin 27 projected from the inner plate 25 into a hole 22 formed on the outer plate 21 and by threadedly engaging a stopper screw 29 into a threaded hole 23 formed on the outer plate 21 through a hole 28 formed on the inner plate 25. Thus, the cleaning member 20 can be moved along the opening 14 without rotating.

The projected wire cleaner portions 26A and 26B or 26C and 26D are disposed at both sides of the wire and deviated slightly from each other in the extending direction of the wire so that they pinch the wire therebetween.

Figure 6A:
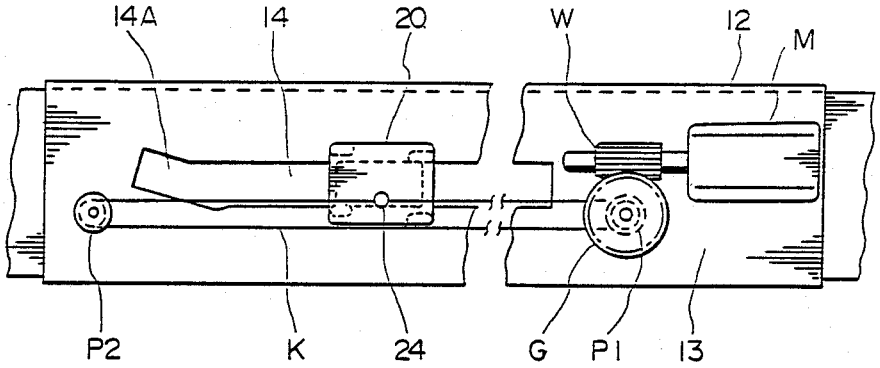
FIGS. 6A and 7A are left side views of the charging apparatus.
Figure 6B:
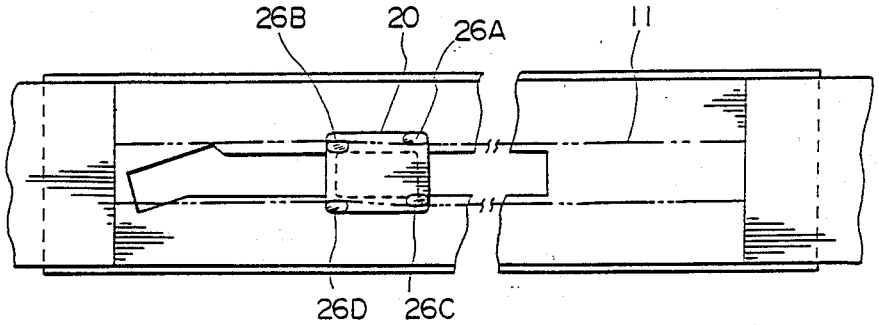
FIGS. 6B and 7B are right side views of the charging apparatus.

FIGS. 6A and 6B show a left side view and a right side view of the charging apparatus shown in FIG. 4, respectively, under the state that the wires 11 are being cleaned by the sliding cleaning member 20.

A motor M and a worm gear W connected to the motor M are mounted outside of the back plate 13. A drive wire K is trained between a pulley P1 having a worm wheel G meshed with the worm gear W and a pulley P2 disposed facing the pulley P2 through the opening 14. The drive wire K is fixed to said cleaning member 20 through a projection 24 formed on the outer plate 21.

When the copy number reaches a predetermined number, the motor M is automatically energized to rotate the worm wheel G in the clockwise direction, so that the cleaning member 20 is slidingly moved in the rightward direction.

As shown in FIG. 6B, said wire cleaner portions 26A and 26B or 26C and 26D are disposed so that they can stroke the wires 11 to clean them when they are sliding.

In the present invention, a cam groove 14A is provided obliquely at one end of the opening 14 of said shielding member 12 for retracting and separating said cleaning member 20 from the wire at the end portion of the shielding member when the discharging is to be effected by the wire.

When said cleaning member 20 has reached the right end of the opening 14 and stopped, the variation of motor current is detected to switch the wiring circuit, so that the motor M is rotated in the reverse direction. Accordingly, the cleaning member 20 is moved to the initial portion of said opening 14 where the cam groove 14A provided, and stopped, so that the motor current is varied. Upon the detection of the variation, the motor M is deenergized.

Figure 7A:
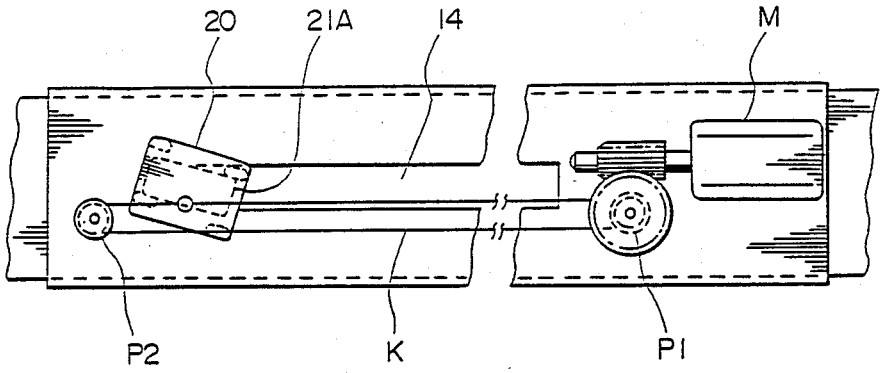
Figure 7B:
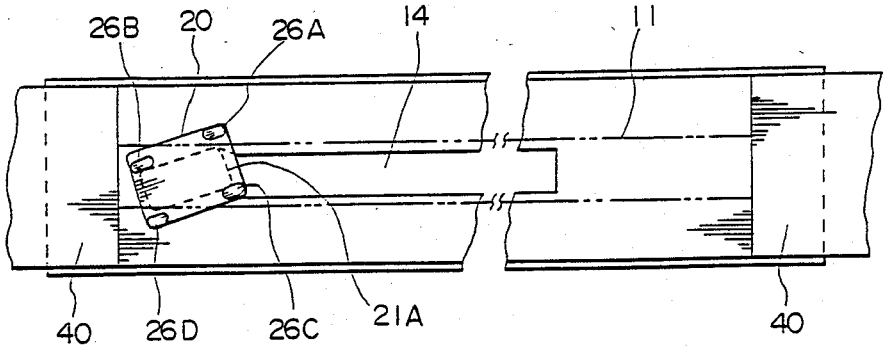

FIGS. 7A and 7B show a left side view and a right side view of the charging apparatus shown in FIG. 4, under the state that said cleaning member 20 has moved to the cam groove 14A and stopped.

When the motor M is rotated in the reverse direction to rotate the worm wheel G in the counter-clockwise direction, said cleaning member 20 is retracted into the cam groove 14A and rotated slightly through the step portion 21A along an inclined surface of the cam groove 14A, so that the wire cleaner portions 26A and 26B or 26C and 26D are separated from the wire 11, respectively. As a result, the wire 11 which had been nipped between the wire cleaner portions is restored to a tensile state between electrode blocks 40 by the tensile force of the blocks 40.

In such construction, an edge of the cam groove 14A crosses the discharging wire 11 or the width and the position of the end portion of the opening 14 are varied partly, so that the conditions for the normal discharging becomes disordered, thereby causing the lightning to the edges of the cam groove 14A and the end of the opening 14 being occurred.

In this state, however, the edge portion of the cam groove 14A is covered with said outer plate 21 and inner plate 25 of said cleaning member 20 which have been moved to the cam groove 14A.

Accordingly, the lightning to the edge portion of the cam groove 14A is prevented from being occurred, because said portion is covered with the electrically insulating material of the cleaning member 20, even if the edge portion of the cam groove 14A is crossed the discharging wire 11. Specifically, said cleaning member 20 has both functions of cleaning the discharging wire 11 and of preventing the occurrence of the lightning.

The charging apparatus for the electrostatic recording equipment according to the invention therefore enables effective discharging to the photosensitive member without producing lightning while at the same time minimizing the corona winds generated by discharging. This prevents dispersing of toner particles and assures proper application of charges to the drum, producing copy images of high quality.

The charging apparatus of the invention enables further effective cleaning of the discharging wire by the compact cleaning member which can be retracted and separated from the wire when the discharging is to be effected and can prevent occurrence of lightning to the edges of the cam groove and the opening formed on the back plate.

What is claimed is:

1. In a charging apparatus comprising a discharging wire, a shielding member U-shaped in cross section, and a wire cleaning member for cleaning said wire, the improvement wherein a back plate forming a back portion of said shielding member has an elongate opening for guiding said cleaning member and defining a cleaning region of said wire and a cam groove communicating said elongate opening for separating the cleaning member from the wire.

2. The charging apparatus according to claim 1, wherein said discharging wire is formed by a pair of discharging wires disposed in parallel with each other with a distance therebetween larger than the width of said opening.

3. The charging apparatus according to claim 2, wherein said cam groove crosses at least one of said wires.

4. The charging apparatus according to claim 1, wherein the distance between said discharging wire and a side plate of the shielding member is larger than the distance between said discharging wire and said back plate.

5. The charging apparatus according to claim 1, wherein said cleaning member has wire cleaner portions disposed at both sides of said wire and deviated in the extending direction of the wire so as to be brought into engagement with the wire.

6. The charging apparatus according to claim 1, wherein at least surface portions of side plates of said shielding member facing the discharging wire are insulated.

* * * * *